US006676069B1

(12) United States Patent
Davis

(10) Patent No.: US 6,676,069 B1
(45) Date of Patent: Jan. 13, 2004

(54) MODULAR HOLIDAY LIGHT STORAGE AND DISPENSING SYSTEM

(76) Inventor: Eleanor Jewel Davis, 5706 S. Fairfax, Los Angeles, CA (US) 90056

( * ) Notice: Subject to any disclaimer, the term of this patent is extended or adjusted under 35 U.S.C. 154(b) by 0 days.

(21) Appl. No.: 10/115,760

(22) Filed: Apr. 3, 2002

(51) Int. Cl.[7] ..... B65H 75/14

(52) U.S. Cl. ..... 242/609.1; 242/405.2; 242/407.1; 242/578.2; 242/588.2; 242/609.3; 242/608.5

(58) Field of Search ..... 242/608.5, 609.1, 242/609.3, 578.2, 588.2, 405.2, 405.3, 407, 407.1

(56) References Cited

U.S. PATENT DOCUMENTS

| | | | | |
|---|---|---|---|---|
| 4,193,563 A | | 3/1980 | Vitale | 242/85 |
| 4,917,323 A | | 4/1990 | Wing | 242/96 |
| 5,467,938 A | * | 11/1995 | Redman | 242/609.1 |
| 5,526,931 A | | 6/1996 | White | 206/420 |
| D375,251 S | | 11/1996 | Stevens et al. | D8/359 |
| 5,661,953 A | | 9/1997 | Jolley | 53/430 |
| 5,957,401 A | | 9/1999 | Odonnell | 242/404.3 |
| 6,241,176 B1 | * | 6/2001 | McEntee | 242/405.3 |

* cited by examiner

*Primary Examiner*—John Q. Nguyen
(74) *Attorney, Agent, or Firm*—Goldstein & Lavas, P.C.

(57) ABSTRACT

A holiday light storage system, for storing holiday string lights, having a central hub and extension hubs. The central hub has a pair of parallel flange disks and a core extending perpendicularly between the flange disks. The core allows adjustment of the relative distance between the flange disks. End bores extend through the flange disks coaxially into the core. The extension hubs each have a flange ring and an extension core. The extension core has a threaded end opposite the flange ring for attaching into one of the end bores of the central core. A handle is selectively axially attachable in one of the end bores. The system is configurable by the user according to the storage needs of the user.

4 Claims, 6 Drawing Sheets

MODULAR HOLIDAY LIGHT STORAGE AND DISPENSING SYSTEM

BACKGROUND OF THE INVENTION

The invention relates to a holiday light storage and dispensing system. More particularly, the invention relates to a system capable of storing and then dispensing strings of holiday lights which may be custom configured according to the particular needs of the user.

Festive lighting enhances the holiday mood, and crosses all religious boundaries. The most common type of festive lighting are holiday light "strings". They include numerous bulbs, spaced apart along a cord which both provides power to the bulbs and provides a means for attaching the lights onto a Christmas tree or a building structure.

Because of their seasonal nature, light strings are displayed for a limited time, and then must be stored for re-use the following year. Unfortunately, when one attempts to retrieve them from storage the following year, they are typically tangled. Untangling the lights typically involves stretching them in long runs along the floor. However, once "stretched out", it is inconvenient to string the lights—especially around a Christmas tree. Further, the storing, retrieving, and untangling operation often results in numerous broken bulbs.

Thus, there is a need for a system which allows a user to conveniently store holiday light strings. Such a system should be customizable according to the needs of the user, and should allow the light strings to be easily dispensed to simplify the task of holiday decoration.

In this regard, others have proposed units which seek to allow for storage of holiday lights. In particular, U.S. Pat. Nos. 375,251 to Stevens et al. and U.S. Pat. No. 5,661,953 to Jolley both disclose systems which have hubs for storage of multiple light strings. Unfortunately, these systems are designed to remain stationary on a flat surface, whereas a crank is used to dispense the lights. Because of this, these systems are wholly unsuitable for the most typical dispensing operation—decorating a Christmas tree or building from a ladder.

Similarly, U.S. Pat. No. 5,957,401 to O'Donnell discloses a large hub which is most suitable for use resting on the ground, while a user pulls upon the string from the ladder above. O'Donnell can alternatively be mounted on the ladder as well with a hook—but clearly is not intended to be hand-held during use.

U.S. Pat. Nos. 4,193,563 to Vitale and 5,526,931 to White both disclose systems which provide multiple hubs for storage of electrical cords, and are at least intended for hand-held use. Unfortunately, these systems lack flexibility for accommodating the needs of the individual user. Further, Vitale is intended for use with ordinary power cords, which are capable of making 180 degree turns in a short space. As such, Vitale is unsuitable for use with holiday light strings because the "bulk" created by the bulbs on the light strings.

U.S. Pat. No. 4,917,323 to Wing employs one or more disks which fit upon a central cylinder to allow multiple areas for light storage. Unfortunately, the expansion of the system is limited by the size of the cylinder. Further, Wing is awkward to hold and rotate while storing and dispensing lights.

While these units may be suitable for the particular purpose employed, or for general use, they would not be as suitable for the purposes of the present invention as disclosed hereafter.

SUMMARY OF THE INVENTION

It is an object of the invention to produce a light storage system which effectively allows holiday light strings to be stored. Accordingly, at least one hub is provided which allows the lights to be conveniently stored and then dispensed therefrom It is another object of the invention to provide a light storage system which is readily adaptable to the needs of the user. Accordingly, each core may expand longitudinally to vary the distance between flange disks, to make storage neater, according to the required amount of storage. Further, multiple hubs may be axially interconnected to provide additional storage.

It is still another object of the invention to provide a light storage system which is easily hand-held, and may be easily rotated while storing or dispensing the light strings. Accordingly, a handle is provided which is axially attachable, so that it allows the hub to be both held and rotated therefrom. The handle may be easily detached and used on another hub, according to the preferences of the user.

The invention is a holiday light storage system, for storing holiday string lights, having a central hub and extension hubs. The central hub has a pair of parallel flange disks and a core extending perpendicularly between the flange disks. The core allows adjustment of the relative distance between the flange disks. End bores extend through the flange disks coaxially into the core. The extension hubs each have a flange ring and an extension core. The extension core has a threaded end opposite the flange ring for attaching into one of the end bores of the central core. A handle is selectively axially attachable in one of the end bores. The system is configurable by the user according to the storage needs of the user.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
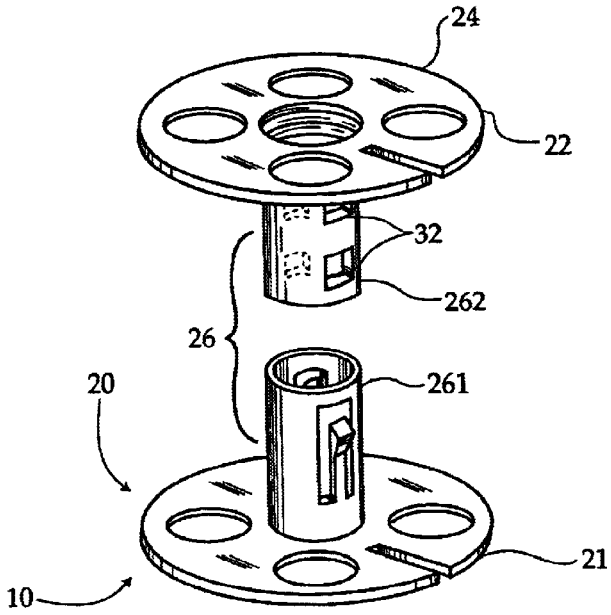
FIG. 1 is an exploded view of a single, central hub according to the present invention.
Figure 2:
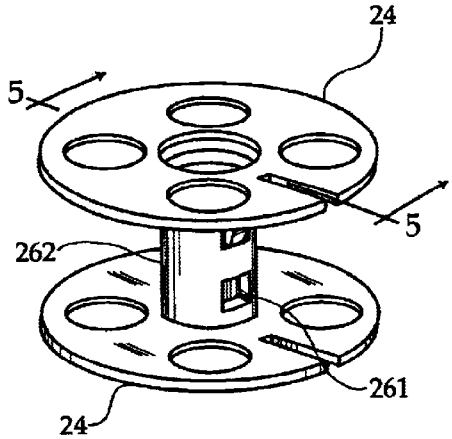
FIG. 2 is a diagrammatic perspective view of the central hub, per se.

FIG. 1 illustrates a holiday light storage and dispensing system 10. More particularly, in FIG. 1, a central hub 20 of the system 10 is illustrated. The central hub 20 has a pair of flange disks 24 and a core 26 centered on and extending perpendicular to the flange disks 24, which connects both flange disks 24 together. The central hub 20 has a first part 21 and a second part 22, wherein the core 26 is divided into a core first part 261 and core second part 262. The core first part 261 and core second part 262 are sized to attach coaxially and telescope with respect to each other to adjust the relative distance between the flange disks 24. In particular, the core 26 has an adjustment mechanism 28, which may include a latch 30 on the first part 261 and at least two longitudinally spaced latching openings 32 on the second part 262. Thus the adjustment mechanism 28 locks the core first part 261 and core second part 262 and thus fixes the relative position or distance between the flange rings 24 in at least two positions. The central hub 20 is assembled, as seen in FIG. 2, wherein the two core parts 261 and 262 are engaged and locked together, creating a spindle defined by the core 26 and boundaried by the two flange disks 24.

Figure 5:
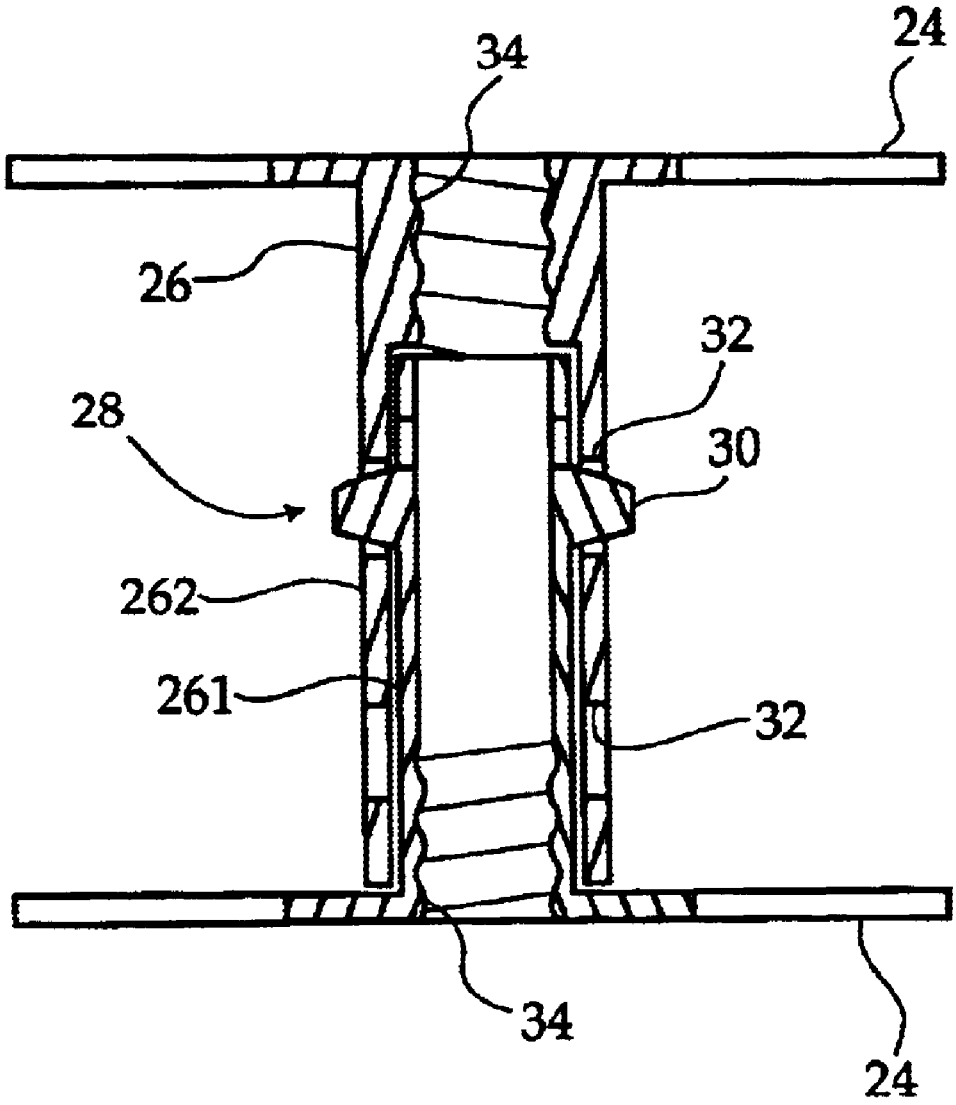
FIG. 5 is a cross sectional view, taken in the direction of line 5—5 in FIG. 2, illustrating an adjustment mechanism of the present invention.

Referring to FIG. 5, the latch 30 is engaged with one of the longitudinally spaced latch openings 32. However, if it is desired, the latch 30 may be pushed inward while the flange disks 24 are pulled apart, until the latch 30 clicks into the other of the longitudinally spaced latch openings 32. It should be noted that on FIG. 5, two latches are provided separated by one hundred eighty degrees around the core 26. Similarly, two pairs of longitudinally spaced latch openings 32 are present on the core second part 262. The two pairs are separated circumferentially around the core second part 262 by one hundred eighty degrees. To avoid confusion, the at least two longitudinally spaced latch openings referred to are those which are vertically arranged and are numbered on FIG. 5, which are capable of engaging the same latch (which is numbered in FIG. 5), without rotating the core 26 one hundred eighty degrees. Also seen in FIG. 5, an end bore 34 is centered on each of the flange disks and extends through the flange disk 24 into the core 26, coaxial with the core 26. Both end bores 34 should have the same diameter. Thus, the diameter of the end bore is chosen to fit within the smaller of the first and second core parts 261 and 262.

Figure 3:
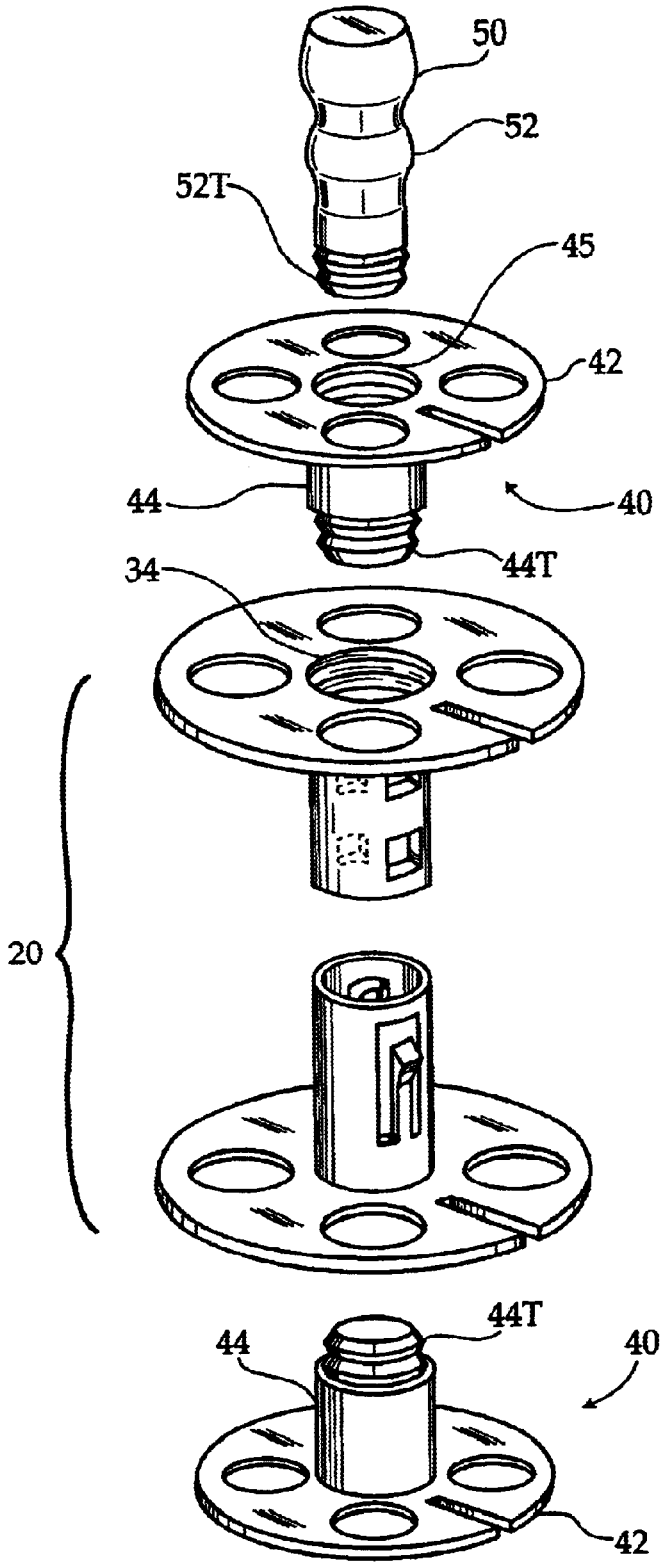
FIG 3 is an exploded view, illustrating additional components of the present invention, which allow expansion upon the single hub, including a detachable handle which is axially attachable to allow the invention to be hand-held.

Referring now to FIG. 3, the expandability of the holiday light system 10 is illustrated. In particular, extension hubs 40 are provided for mating with the central hub 20. The extension hubs 40 have an extension flange ring 42, and an extension core 44 centered on the flange ring 42 and extending perpendicular to the flange ring 42. The extension core 44 has a threaded end 44T, fully opposite from the extension flange ring 42. The threaded end 44T is sized to fit within the end bore 34. Further each extension flange ring 42 has an extension end bore 45 which extends through the flange ring 42 and into the extension core 44 and is coaxial with the extension core 44. Each extension end bore 45 is similar in size to the end bores 34, so that the threaded end 44T can fit attach to either the end bore 34 of the central hub 20 or into the extension end bore 45 of one of the extension hubs 40, so that the two can be axially connected.

Figure 4:
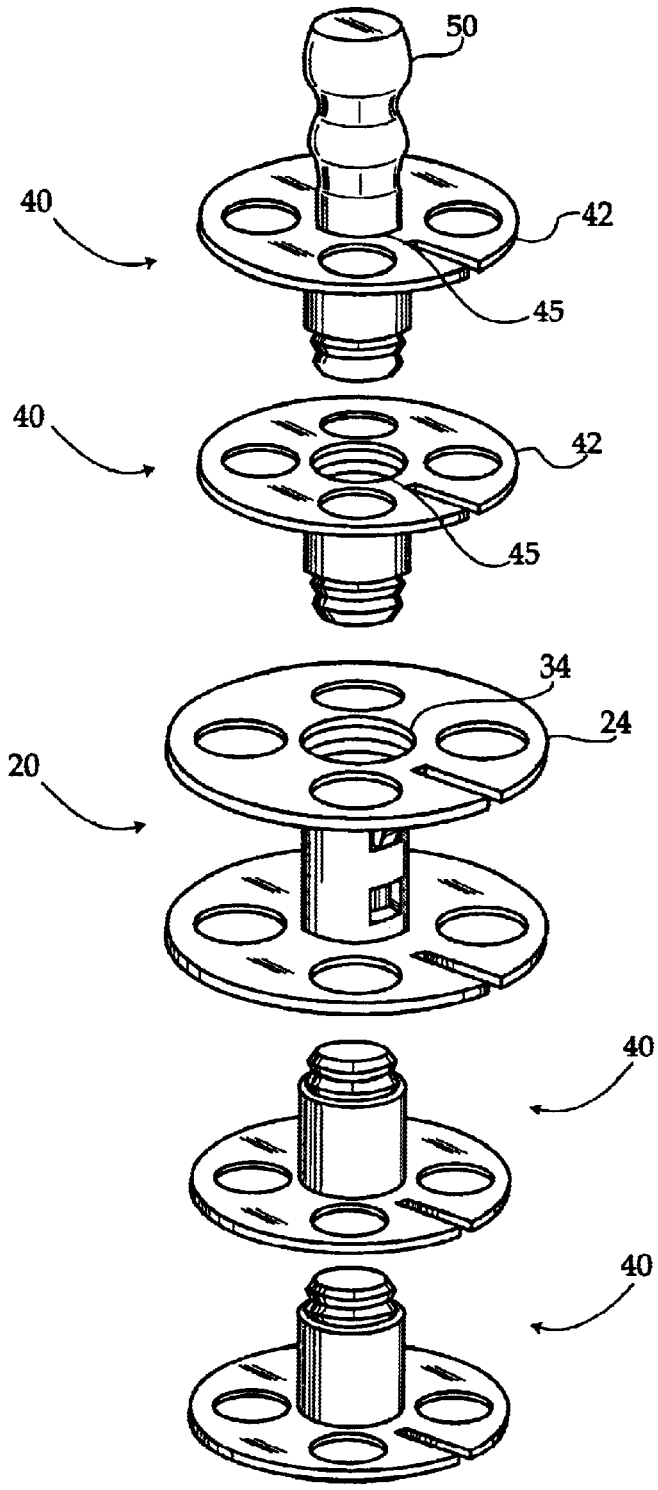
FIG. 4 is an exploded view, similar to FIG. 3, wherein the handle has been attached to one of the expansion hubs.

Further illustrated in FIG. 3, a handle 50 is provided which is substantially cylindrical, having a handgrip 52 and a threaded end 52T. The threaded end 52T of the handle 50 is sized to fit within one of the end bores 34 or one of the extension end bores 45. The handle 50 is generally cylindrical, and is thus selectively mounted axially within one of the end bores 34 or extension end bores 45, and tightly against one of the flange disks 24 or flange rings 42, as illustrated in FIG. 4. FIG. 4 illustrates the further expandability of the system, wherein four extension hubs 40 may be connected to the central hub 20, in addition to the handle 50.

Figure 6:
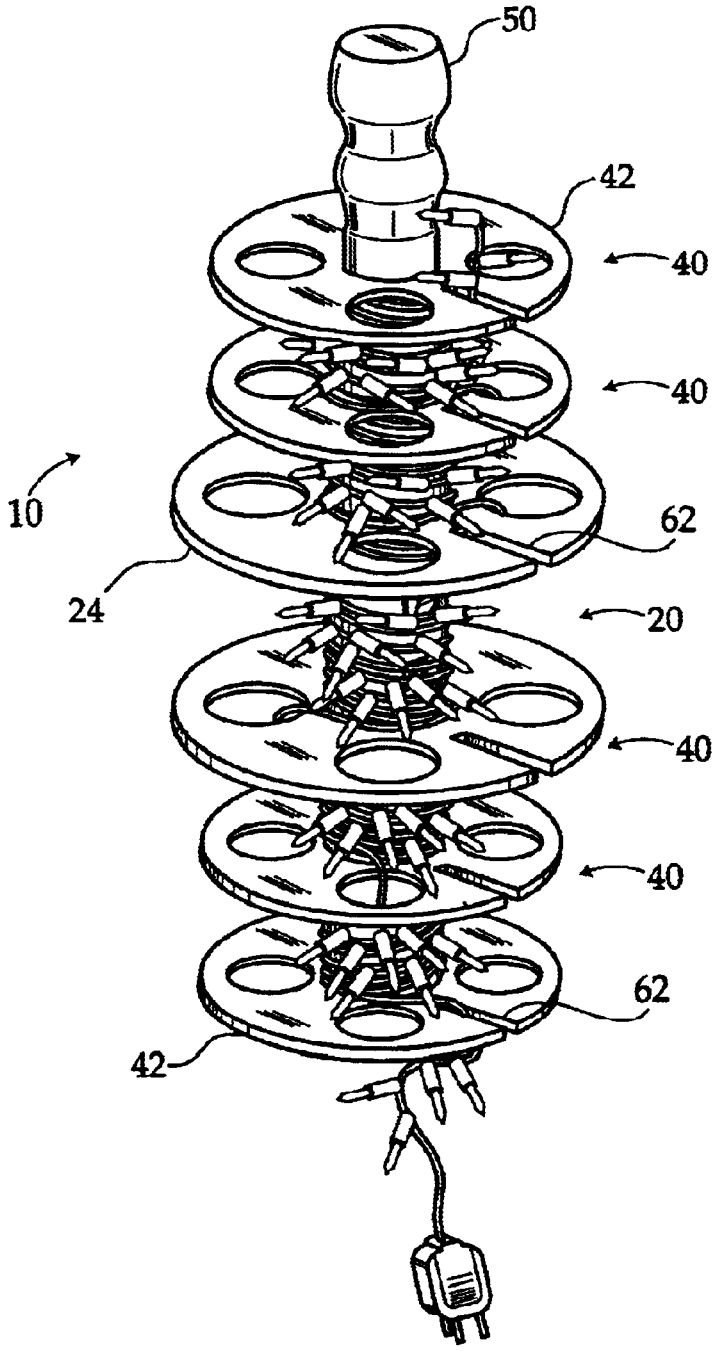
FIG. 6 is a diagrammatic perspective view, illustrating the invention custom configured by the user, wherein multiple hubs have been created according to the needs of the user.

FIG. 6 illustrates the system 10 in a fully assembled configuration which has been custom configured by the user, wherein two extension hubs 40 have been attached on either side of the central hub 20, effectively creating a total of five storage spindles, for storing holiday light strings 60. Notches 62 may be conveniently provided in the flange disks 24 or extension flange rings 42. The notches 62 extend radially inward from the circumference of the flange disk 24 or extension flange ring 42, to allow the holiday light strings 60 to be suitably held in place. The notches 62 are especially well suited for holding the ends of one of the holiday light strings 60. The handle 50 is attached on the top of the assembled configuration against one of the extension flange rings 42.

Figure 7:
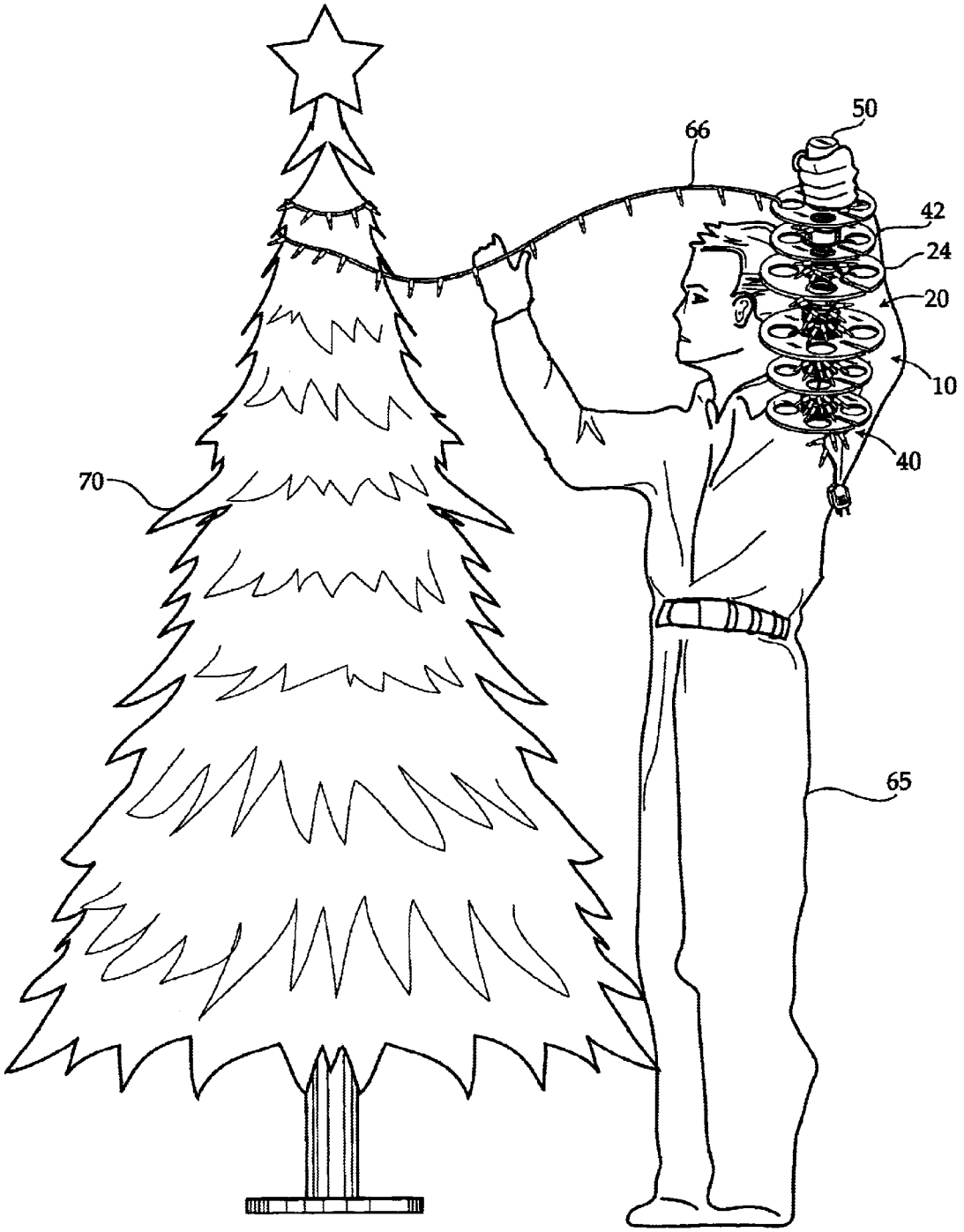
FIG. 7 is a front elevational view, illustrating the invention in use, dispensing or storing a holiday light string onto or from a Christmas tree.

FIG. 7 illustrates the system 10 in use by a person 65 in conjunction with a Christmas tree 70. At least one holiday light string 60 is wrapped around the central hub 20 and spindles created between the disks 24 and rings 42 by the expansion hubs 40. The person 65 is either dispensing or storing the holiday light string 60 using the system 10. The person is holding the system 10 by the handgrip 52 of the handle 50, such that the hubs 20 and 40 may be easily axially rotated to facilitate the dispensing and storage of the holiday string 60.

In conclusion, herein is presented a holiday light storage system which allows holiday light strings to be easily and effectively stored and dispensed. The system is custom configurable by the user according to their particular needs. In this regard, the invention is illustrated by example in the drawings figures and in the foregoing description. However, numerous variations are possible, while adhering to the inventive concept. Such variations are contemplated as being a part of the present invention.

What is claimed is:

1. A holiday light storage system, for use in storing holiday light strings, comprising:

a central hub having a pair of parallel flange disks extending parallel to each other, and a central core connecting the flange disks and extending perpendicular to the flange disks centered on said flange disks, the central core having a first part and a second part, wherein the first part and second part are telescoping to adjust the relative distance between the flange disks, the core further having an adjustment mechanism for fixing the relative distance between the flange disks in at least two different positions, for adjusting an amount of holiday light strings that can be stored on the core, the central hub further having and at least one end bore coaxial with and extending into the core, the at least one end bore internally being threaded;

a handle, the handle having a hand grip and a threaded portion, wherein the handle is selectively attachable in the end bore to provide an axial handle for the central hub;

wherein the central core further has end bores centered on each of the flange rings, extending through the flange rings and into the core, the end bores are both internally threaded to allow selective attachment of an item selected from the extension core and the handle; and at least one extension hub, the extension hub having a flange ring and an extension core centered on the flange ring and extending perpendicular thereto, the extension core having a threaded end opposite from the flange ring for selectively attaching in the end bore of the central hub to create a spindle between the flange ring and one of the flange disks of the central core for storing holiday light strings.

2. The holiday light storage system as recited in claim 1, wherein the adjustment mechanism further comprises a latch extending on the first core part, and a pair of longitudinally spaced holes on the second core part, such that the latch selectively engages one of the longitudinally spaced holes to fix the relative distance between the flange disks.

3. The holiday light storage system as recited in claim 2, wherein the extension hub has an internally threaded extension end bore, extending through the flange ring and into the extension core, the extension end bore sized to selectively accommodate the threaded portion of the extension core of another extension hub, and to selectively accommodate the handle.

4. The holiday light storage system as recited in claim 3, comprising at least two extension hubs which selectively attach into the end bores of the central hub, and wherein the handle selectively attaches into one of the extension end bores.

* * * * *